United States Patent [19]

Desilets

[11] 4,190,132

[45] Feb. 26, 1980

[54] SPIDER THREAD

[76] Inventor: Jean-Paul Desilets, 7952 NE. 4th Ave., Miami, Fla. 33138

[21] Appl. No.: 682,750

[22] Filed: Jun. 7, 1976

[51] Int. Cl.[2] ..... A62B 1/08; A62B 35/00

[52] U.S. Cl. ..... 182/6

[58] Field of Search ..... 182/5, 6, 7, 4, 3; 254/151, 154

[56] References Cited

U.S. PATENT DOCUMENTS

| | | | |
|---|---|---|---|
| 1,144,702 | 6/1915 | Forest | 182/5 |
| 1,631,279 | 6/1927 | Mandy | 182/7 |
| 2,561,832 | 7/1951 | Wilson | 182/7 |
| 2,680,593 | 6/1954 | McIntyre | 182/7 |

*Primary Examiner*—Reinaldo P. Machado

[57] ABSTRACT

The "Spider Thread" is a device which enables a person to descend from a point, much like a spider coming down from a ceiling. Its main part is a reel on which a long, flat strip (preferably steel) is wound. Said reel is placed between two plates that form the body of the device, and all parts are held together by a center bolt and a wing nut which when tightened press the plates against the reel and provide a brake that controls the rate of the descent. When used, the strip is first securely fastened or hooked at the starting point. The user must wear a harness which he connects to a hook provided for that purpose at the above mentioned plates.

2 Claims, 10 Drawing Figures

Fig. 6
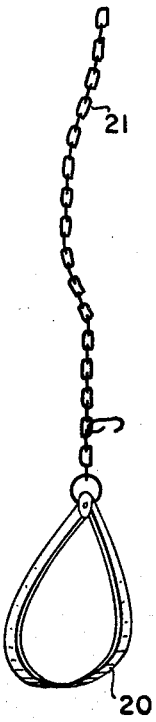
Fig. 6a
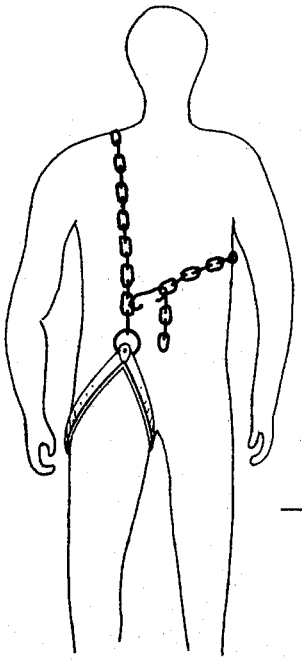
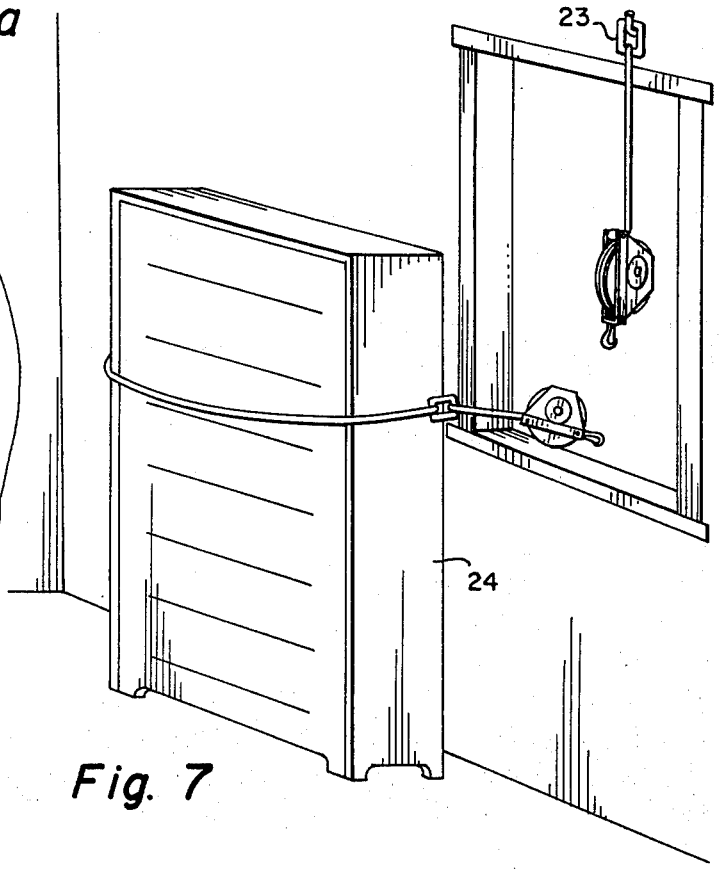
Fig. 7
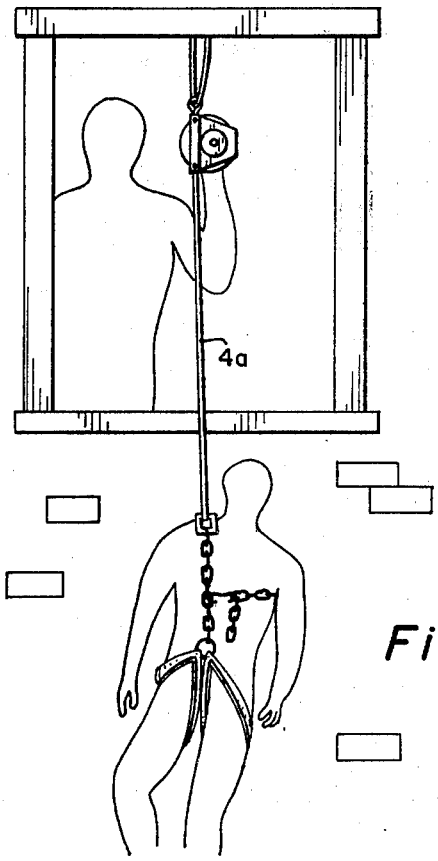
Fig. 8
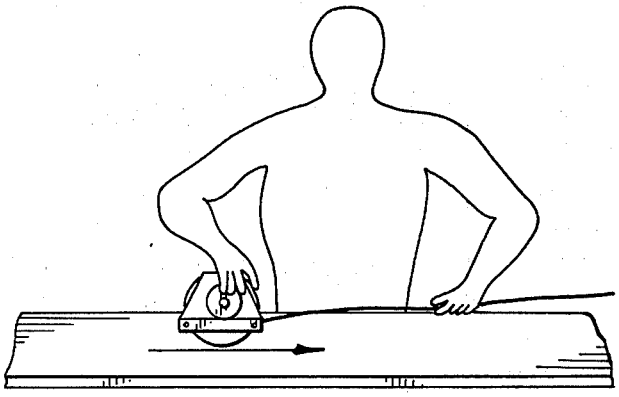
Fig. 9

SPIDER THREAD

DESCRIPTION

This device could have several uses, but its main purpose would be to escape from a building on fire, by descending from a window or the roof. The user, wearing a harness connected to a hook provided for that purpose at the device can control the rate of his descent by means of a wing nut or a knob projecting from one side of the device.

FIG. 6 shows a more simple harness using only one loop.

FIG. 6*a* shows the harness of FIG. 6 on a person.

FIG. 7 Two ways of fastening the strip at the starting point.

FIG. 8 shows another way of using the "Spider Thread" by reversing the operation for descending a disabled person.

FIG. 9 shows the operation of rewinding the strip should it become necessary.

Figure 2:
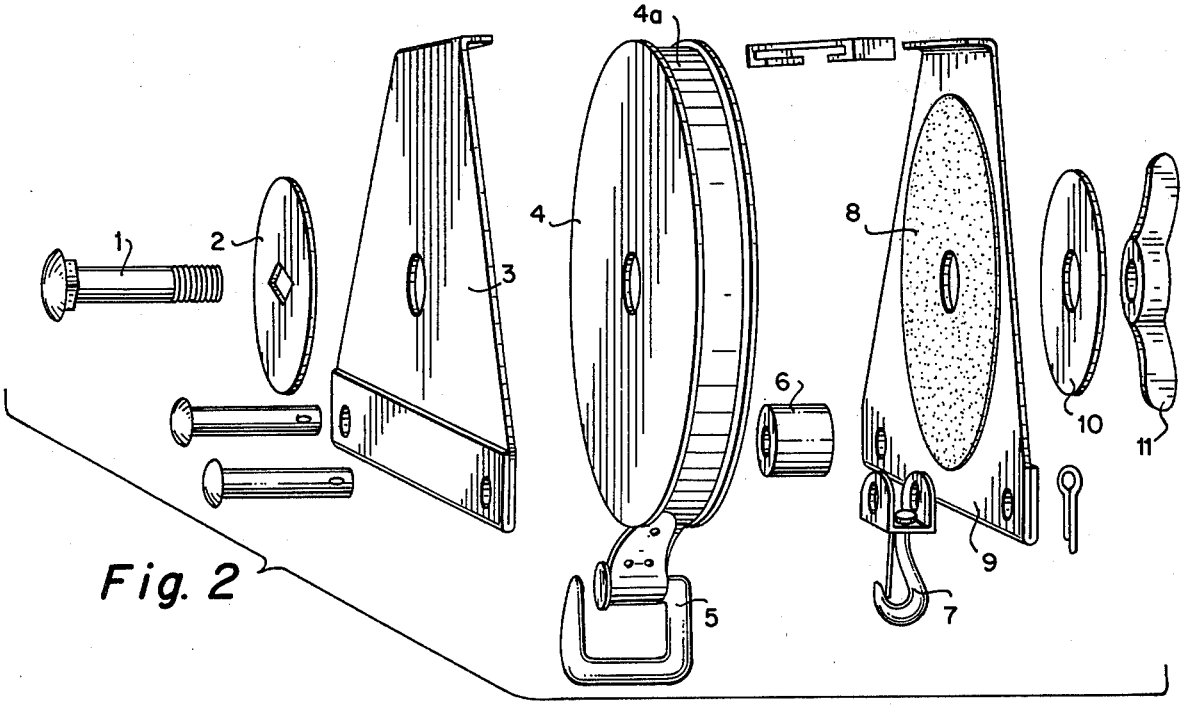
FIG. 2 is an exploded view of the same device.

The main part of the "Spider Thread" is a long strip of strong material 4*a* (steel is recommended) wound on a reel (4) FIG. 2 after one end of said strip is securely fixed to the core of said reel. Two plates (3) and (9) FIG. 2, which could be identical and having a coat of friction material (8) inside to provide a good braking action, form the body of the device. A bolt, a wing nut and a pair of convex discs 2 and 10 hold the parts together and are used to apply and control the brake. Holes are provided at the plates for a roller (6) that keeps the strip in place and for a strong snap hook (7) FIG. 2 that must support the weight of the user.

The harness 20 FIGS. 3 to 6 could have one or two loops made of strong material like nylon for the legs of the user. Said loops are connected to a chain 21 which, when used, is passed over the right shoulder and brought back at the front from under the left arm where it is connected at a convenient place (14) FIG. 5 with a double snap hook 22. It can be put on in a jiffy by practically anybody.

Figure 1:
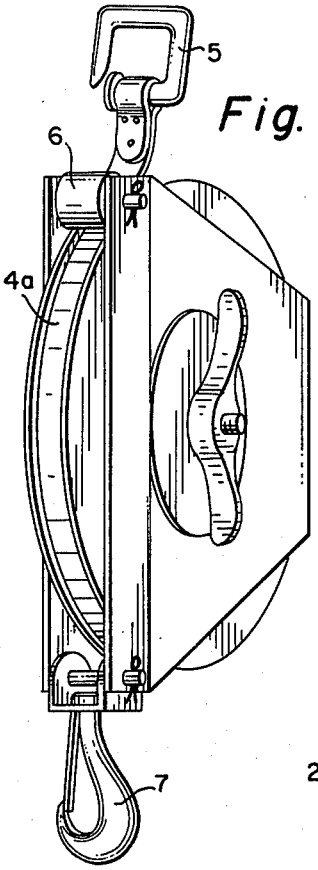
FIG. 1 shows a perspective view of the "Spider Thread".
Figure 3:
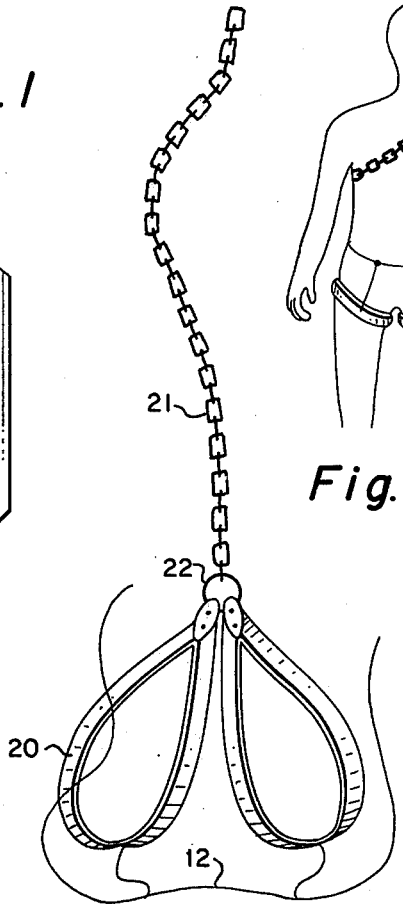
FIG. 3 shows the harness made with two loops and a string that helps keep the loops in place.
Figure 4:
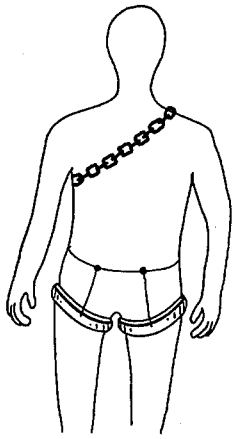
FIG. 4 shows the same harness on a person seen from behind.
Figure 5:
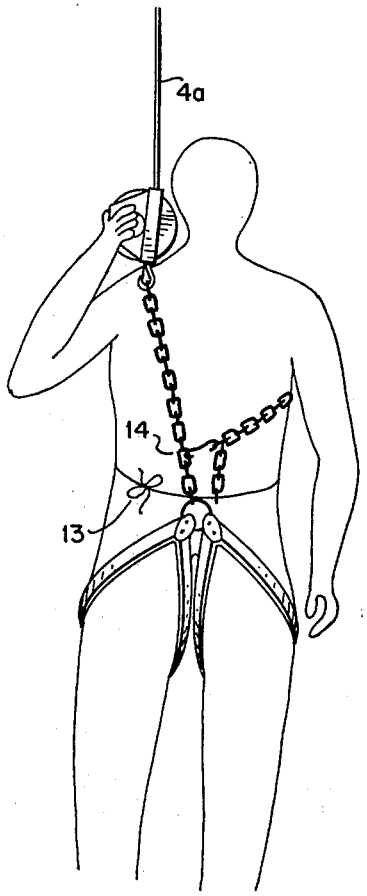
FIG. 5 shows the whole apparatus being used.

The easiest way to use the "Spider Thread" would be to have a strong hook 23 provided for that purpose above a window as in FIG. 7. This hook could be covered with draperies. Another way would be to use part of the steel strip to encircle a heavy piece of furniture 24 like a bed, a sideboard etc. . . using the buckle (square ring) (5) FIG. 2 and inserting the strip in the gap of said buckle to form a loop around the furniture FIG. 7. The reel is then taken just outside the window sill where the brake is tightened, and that is the point where the descent will start. The user, while inside, will then connect the reel hook (7) FIG. 1 to a link of the harness chain a little lower than the shoulder. He is now ready to get through the window and start his descent by slowly releasing the brake, FIG. 5.

It is easy to roll back a few feet of the strip or all of it, should it become necessary, as illustrated in FIG. 9. The case is held with the right hand, keeping one finger on the reel which is rolled in direction of the arrow, a few feet at each stroke.

I built a working model of the "Spider Thread". I made the plates and the reel out of 0.060" steel. The reel is 6" Diam., it holds 100 feet of steel strip $\frac{3}{4}'' \times 0.020''$. An 8" reel should hold close to 200 feet.

I claim:

1. A device that enables a person to make an emergency descent from outside a building or an elevated place, said device comprising a flexible longitudinal flat band (preferably steel band) one end of which must be fastened at the starting point, said flat band being wound on a reel made of two connected disks by a core having a center hole, two L-shaped plates connected at one end thereof with center holes and having a trapezoidal shape placed one on each side of said reel with friction material between said plates and said reel, said plates forming the body of the device and at the opposite end having two corners extending beyond the circumference of the reel in order to install a roller at one of said corners and a snap hook at the other corner, said hook is adapted to be connected to a harness worn by the user, two convex disks having center holes placed one on each side of said plates, the above mentioned parts, reel, plates and disks being held together by a bolt through their center holes, said bolt being used as an axle for the reel and as a means to apply a braking effect on the reel by pressing the plates against said reel when a threaded knob or handle at the threaded end of the bolt is being tightened with one hand, thus enabling the user to control the rate of his descent.

2. A device as defined in claim 1 being connected to said harness worn by the person making the descent and made of one or two loops connected to a chain, said loops made of strong material like nylon . . . etc, and adapted to support the user by one or both legs, when worn, said chain being passed from the front to the back of the user over the right shoulder and brought back to the front from under the left arm and then connected to the front part of the chain at or near the loops with a double snap hook.

* * * * *